US010125720B2

(12) United States Patent
Burns et al.

(10) Patent No.: US 10,125,720 B2
(45) Date of Patent: Nov. 13, 2018

(54) CASTING ASSEMBLY AND METHOD TO PROVIDE MAGNETIC RETENTION FOR OVER-MOLDED INSERTS IN DIE CAST TOOLING

(71) Applicant: FORD MOTOR COMPANY, Dearborn, MI (US)

(72) Inventors: Jonathan Robert Burns, Windsor (CA); Bryan McKeough, Macomb, MI (US); Jacob Wesley Zindel, Ann Arbor, MI (US); Robert Gordon Rentschler, Dearborn, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 302 days.

(21) Appl. No.: 15/207,608

(22) Filed: Jul. 12, 2016

(65) Prior Publication Data

US 2018/0017016 A1 Jan. 18, 2018

(51) Int. Cl.

| | |
|---|---|
| ***B22D 19/04*** | (2006.01) |
| ***B22C 9/24*** | (2006.01) |
| ***F02F 7/00*** | (2006.01) |
| ***B22C 9/10*** | (2006.01) |
| ***B22C 23/00*** | (2006.01) |
| ***B22D 21/00*** | (2006.01) |
| ***B22D 45/00*** | (2006.01) |

(52) U.S. Cl.

CPC ..... *F02F 7/0095* (2013.01); *B22C 9/101* (2013.01); *B22C 9/108* (2013.01); *B22C 9/24* (2013.01); *B22C 23/00* (2013.01); *B22D 19/04* (2013.01); *B22D 21/007* (2013.01); *B22D 45/00* (2013.01); *F02F 7/0085* (2013.01); *F02F 2200/06* (2013.01)

(58) Field of Classification Search

CPC ..... B22C 9/24; B22D 25/02

See application file for complete search history.

(56) References Cited

U.S. PATENT DOCUMENTS

| | | | | |
|---|---|---|---|---|
| 3,439,732 | A | 4/1969 | Andreoli | |
| 4,271,895 | A | 6/1981 | Cole et al. | |
| 4,362,205 | A * | 12/1982 | Cole | B22D 19/0054 164/109 |
| 6,299,426 | B1 | 10/2001 | Scanlan | |
| 7,047,928 | B2 | 5/2006 | Rengmyr | |
| 7,409,982 | B2 * | 8/2008 | Newcomb | B22C 9/103 164/148.1 |

(Continued)

FOREIGN PATENT DOCUMENTS

| | | |
|---|---|---|
| AU | 2013101376 | 11/2013 |
| JP | H08189415 | 7/1996 |
| JP | 2014176861 | 9/2014 |

*Primary Examiner* — Kevin E Yoon

(74) *Attorney, Agent, or Firm* — Carlson, Gaskey & Olds, P.C.

(57) ABSTRACT

An exemplary casting assembly for an engine block includes, among other things, an insert and at least one magnet configured to retain the insert in a predefined position within an engine block mold cavity. An exemplary engine block casting method includes, among other things, positioning at least one insert in a mold cavity, retaining the insert in position with at least one magnet, introducing material into the mold cavity to form an engine block, and solidifying the material to secure the insert within the engine block.

8 Claims, 3 Drawing Sheets

(56) References Cited

U.S. PATENT DOCUMENTS

| | | | | |
|---|---|---|---|---|
| 8,662,141 | B2 | 3/2014 | Carlson et al. | |
| 2014/0261285 | A1* | 9/2014 | Williams ..... | F02F 7/0021 123/195 R |
| 2015/0056470 | A1 | 2/2015 | Aoyama et al. | |
| 2016/0040621 | A1 | 2/2016 | Beyer et al. | |

* cited by examiner

CASTING ASSEMBLY AND METHOD TO PROVIDE MAGNETIC RETENTION FOR OVER-MOLDED INSERTS IN DIE CAST TOOLING

TECHNICAL FIELD

This disclosure relates generally to magnetic insert retention in die cast tooling. More particularly, the disclosure relates to magnetic insert retention and position control for over-molded inserts in die cast tooling for an engine block.

BACKGROUND

Die cast components can be configured to incorporate over-molded (cast-in-place) inserts that provide certain attributes that are not attainable in a bulk cast media, or which are not feasible to create in the cast tooling process. The insert can be positioned and retained within the tooling via tooling design features. However, certain types of components provide unique challenges for over-molded inserts.

One such component is a cast-in-place main journal, also known as a "bulkhead insert," for a high pressure die cast engine block. The geometry of the insert is such that it cannot be secured within the tooling without the use of opposed die halves. The use of opposing die halves to secure the insert presents the risk of collision between the halves that could potentially damage the tooling or produce a part with a compromised insert that may be difficult to detect in the finished casting operation.

SUMMARY

A casting assembly for an engine block according to an exemplary aspect of the present disclosure includes, among other things, an insert and at least one magnet configured to retain the insert in a predefined position within an engine block mold cavity.

In a further non-limiting embodiment of the foregoing casting assembly, the insert comprises a bulkhead insert defining an engine crank bore.

In a further non-limiting embodiment of any of the foregoing casting assemblies, the magnet comprises an electromagnet or permanent magnet.

In a further non-limiting embodiment of any of the foregoing casting assemblies, an electrical circuit cooperates with the at least one magnet to detect a presence of the insert in the engine block mold cavity.

In a further non-limiting embodiment of any of the foregoing casting assemblies, the engine block is aluminum and the insert comprises a material other than aluminum.

In a further non-limiting embodiment of any of the foregoing casting assemblies, the material of the insert comprises a ferrous material.

In a further non-limiting embodiment of any of the foregoing casting assemblies, a cooling circuit cools the at least one magnet if a temperature of the magnet exceeds a predetermined temperature.

In a further non-limiting embodiment of any of the foregoing casting assemblies, the engine block mold cavity is provided within a die, and wherein the die includes a bore configured to receive the magnet, and wherein the cooling circuit is at least partially received within the bore.

In a further non-limiting embodiment of any of the foregoing casting assemblies, there is at least one temperature sensor to determine the temperature of the magnet.

An engine block casting method according to an exemplary aspect of the present disclosure includes, among other things, positioning at least one insert in a mold cavity, retaining the insert in position with at least one magnet, introducing material into the mold cavity to form an engine block, and solidifying the material to secure the insert within the engine block.

In a further non-limiting embodiment of the foregoing method, the material comprises aluminum and the insert is comprised of a material other than aluminum.

In a further non-limiting embodiment of any of the foregoing methods, the material of the insert comprises a ferrous material.

In a further non-limiting embodiment of any of the foregoing methods, the insert comprises a bulkhead insert defining an engine crank bore.

In a further non-limiting embodiment of any of the foregoing methods, the method includes detecting a presence of the insert in the mold cavity prior to introducing material into the mold cavity via an electrical circuit that cooperates with the at least one magnet.

In a further non-limiting embodiment of any of the foregoing methods, the at least one insert comprises at least two inserts and including retaining each insert in position with at least one magnet.

In a further non-limiting embodiment of any of the foregoing methods, the at least two inserts comprise a first bulkhead insert and a second bulkhead insert that each define an engine crank bore.

In a further non-limiting embodiment of any of the foregoing methods, the method includes cooling the at least one magnet if a temperature of the magnet exceeds a predetermined temperature.

In a further non-limiting embodiment of any of the foregoing methods, the magnet comprises an electromagnet or permanent magnet.

A vehicle component casting method according to an exemplary aspect of the present disclosure includes, among other things, positioning at least one insert in a mold cavity, retaining the insert in position with at least one magnet, cooling the magnet if a temperature of the magnet exceeds a predetermined temperature, and introducing material into the mold cavity to form a vehicle component.

In a further non-limiting embodiment of any of the foregoing methods, the vehicle component is an engine block.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to an engine block having a main journal. To create the main journal within the engine block, the engine block is cast about an insert that is referred to as bulkhead insert. The engine block is formed within a die that is configured to hold the insert in a desired position within the die such that the insert can be cast-in-place, i.e. over-molded.

Figure 1:
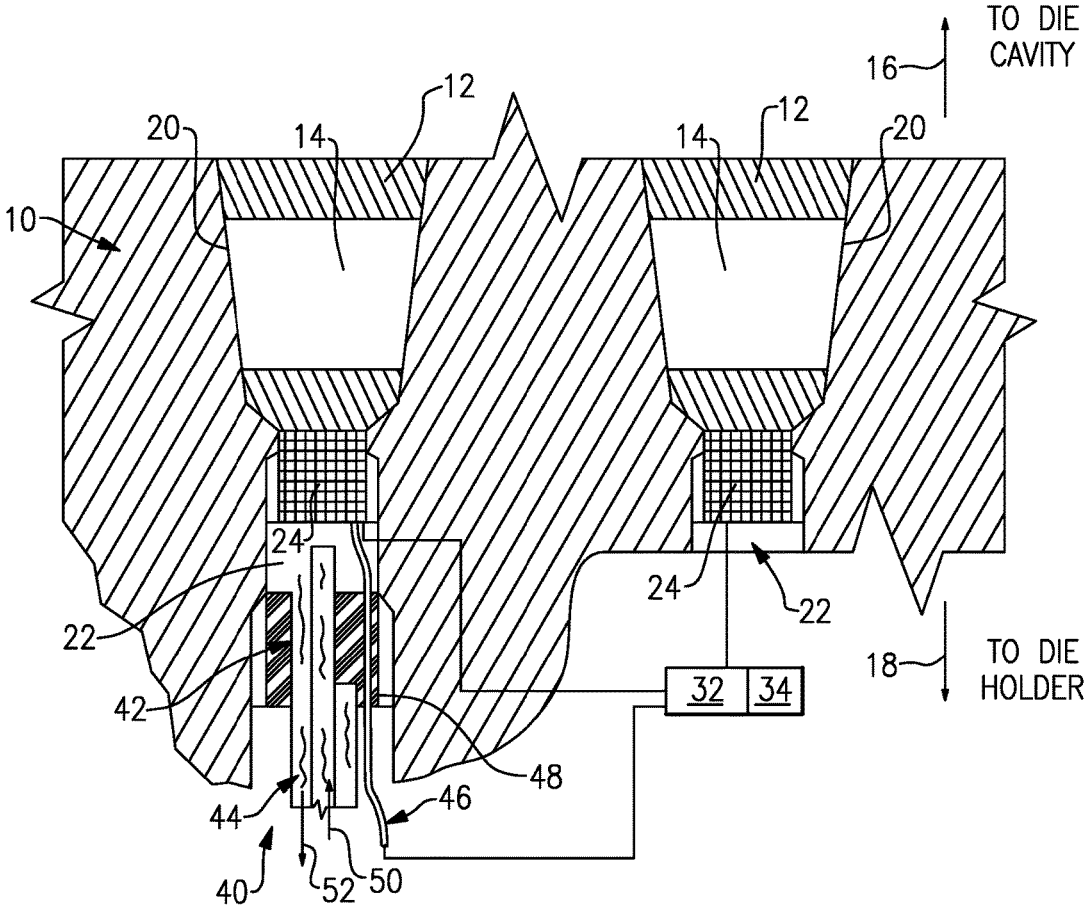
FIG. 1 shows a schematic section view of an example engine block die tooling and bulkhead insert.

FIG. 1 shows a schematic representation of a crank case die 10 including a bulkhead insert 12 that defines a bulkhead insert bore 14. The crank case die 10 has a first side that faces a die cavity as indicated at 16 and a second side that faces a die holder as indicated at 18. The bulkhead insert 12 is located in a first cavity 20 in the die 10 that faces the die cavity 16. The die 10 also includes a second cavity 22 that receives at least one magnet 24 that is used to retain the insert 12 in a desired position within the first cavity 20.

Figure 2:
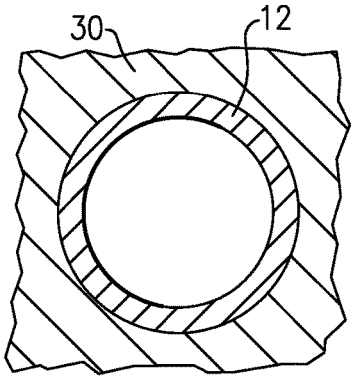
FIG. 2 is a schematic section view of an example engine block with cast-in-place bulkhead insert formed from the tooling shown in FIG. 1.

In one example shown in FIG. 2, an engine block 30 is cast from an aluminum material and the inset 12 comprises a ferrous material. In this example, the ferrous bulkhead insert 12 is incorporated into the engine block 30 during a casting process that utilizes the at least one magnet 24 to hold the insert 12 in the correct orientation during casting. The magnet 24 provides the ability to locate the insert 12 tightly off of a single die piece 10 and does not require any locating assistance from an opposing die half.

In the example shown in FIG. 1 there are two inserts 12 and each insert 12 is retained in the desired position with at least one magnet 24. It should be understood that while the example shows two inserts 12, the tooling could be configured to include additional inserts 12. Further, the magnets 24 could be used to retain other types of inserts that may be needed within the engine block 30.

In one example, the magnet 24 comprises a permanent magnet. In another example, the magnet 24 comprise an electromagnet. As known, permanent magnets create their own magnetic field while electromagnets produce magnetic fields only through the application of electricity. When using a permanent magnet, the magnet should provide sufficient magnetic force to retain the insert 12 in the desired position during the casting process. The electromagnet offers the advantages of being about to control the level of the magnetic force as wells as providing on/off control.

The magnets 24 are positioned within the second cavity 22, which is aligned with the first cavity 20 that receives the insert 12. An electronic control unit 32 is associated with the magnets 24 to detect a presence of the insert 12 in the die 10 prior to introducing material into the die cavity 16. During the casting process, the inserts 12 are placed within the cavity 20 and tightly held in the correct orientation by the magnets 24. Once the presence of the inserts 12 is detected, material is then poured into the die cavity 16 around the inserts 12 and the casting process takes place in a known manner.

Figure 3A:
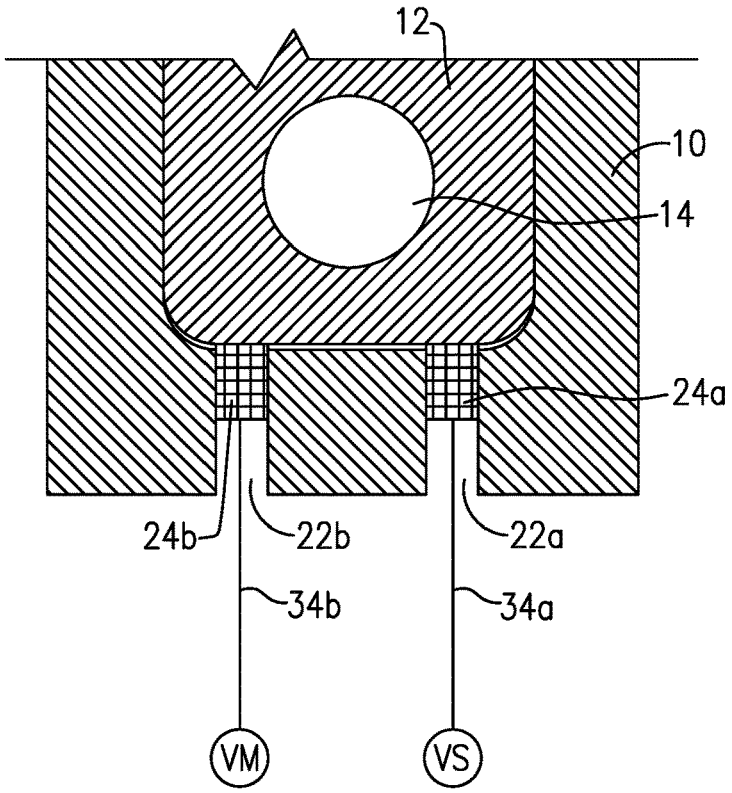
FIG. 3A is a schematic section view of a permanent magnet example for position verification in an engine block die.
Figure 3B:
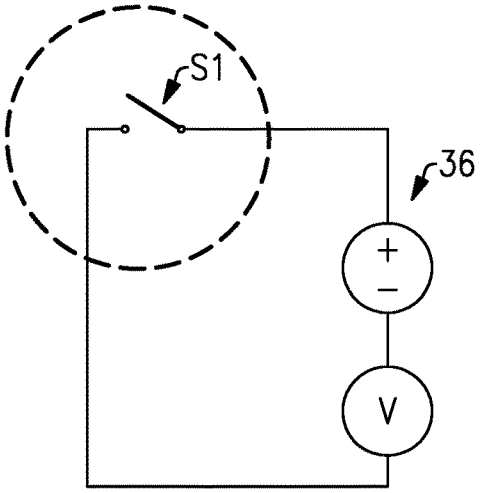
FIG. 3B is an example circuit diagram as used with the permanent magnet configuration of FIG. 3A.

FIGS. 3A-3B show an insert positional verification example for a permanent magnet configuration. As shown in FIG. 3A, the bulkhead insert 12, which defines the crank journal bore 14, is received within die 10. The die 10 includes a first cavity 22*a* for a first permanent magnet 24*a* and a second cavity 22*b* for a second permanent magnet 24*b*. The magnets 24*a*, 24*b* are positioned close to, or in direct contact with, the insert 12. One of the first and second permanent magnets 24*a*, 24*b* is associated with a first line 34*a* in from a voltage supply VS and the other of the first and second permanent magnets 24*a*, 24*b* is associated with a second line 34*b* out to a voltmeter VM.

An example electrical circuit 36 is shown in FIG. 3B, which the electronic control unit 32 uses to detect the presence of the insert 12 in the die 10 prior to introducing material into the die cavity 16. The circuit 36 includes at least one switch S1 that is used to detect the presence of the insert 12. An excitation voltage is supplied to the permanent magnets via the voltage supply VS and the voltage is measured via the voltage meter VM to confirm circuit completion. When the bulkhead insert 12 is present in the die 10, the switch S1 is closed, the circuit 36 is completed and the presence of the insert 12 is confirmed. When the bulkhead insert 12 is not present in the die 10, the switch S1 is open, the circuit 36 is incomplete and the presence of the insert 12 is not confirmed.

Figure 4A:
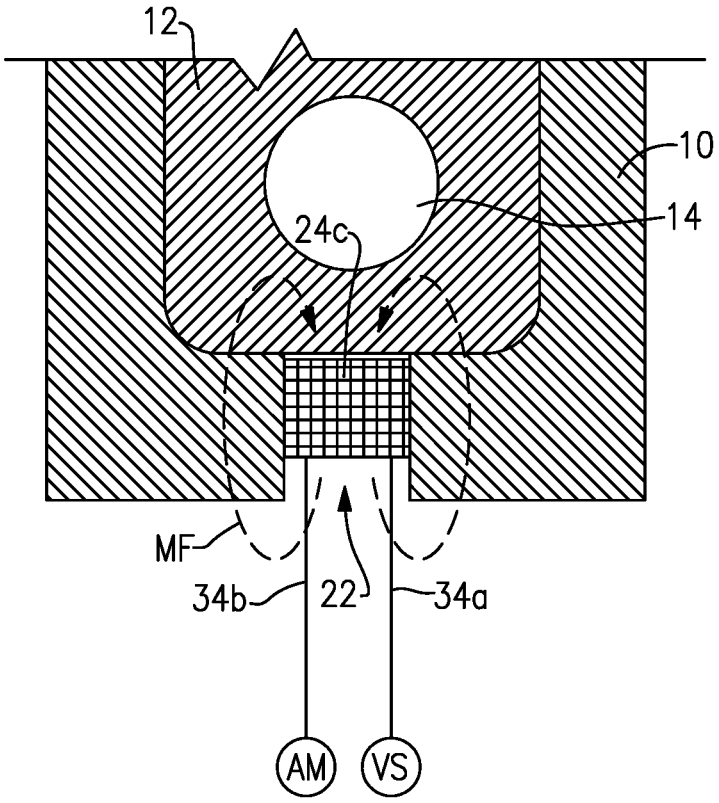
FIG. 4A is a schematic section view of an electromagnet example for position verification in an engine block die.
Figure 4B:
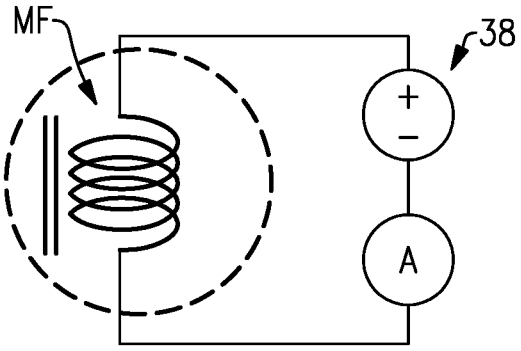
FIG. 4B is an example circuit diagram as used with the electromagnet configuration of FIG. 4A.

FIGS. 4A-4B show an insert positional verification example for an electromagnet configuration. As shown in FIG. 4A, the bulkhead insert 12, which defines the crank journal bore 14, is received within die 10. The die 10 includes a cavity 22 for the electromagnet 24*c*. The electromagnet 24*c* is positioned close to, or in direct contact with, the insert 12. There is a first line 34*a* in to the electromagnet 24*c* from a voltage supply VS and a second line 34*b* from the electromagnet 24*c* out to an ammeter AM.

An example electrical circuit 38 is shown in FIG. 4B, which the electronic control unit 32 uses to detect the presence of the insert 12 in the die 10 prior to introducing material into the die cavity 16. An excitation voltage is supplied to the electromagnet 24*c* via the voltage supply VS and the amperage is measured via the voltage ammeter AM to confirm presence. When the bulkhead insert 12 is present in the die 10 there is an impedance of the magnetic field MF and the presence of the insert 12 is confirmed. When the bulkhead insert 12 is not present in the die 10 there is no impedance of the magnetic field MF and there is confirmation that the insert 12 is not present.

In one example, the magnet 24 is cooled by a cooling circuit 40 that is housed within the die 10. The magnet 24 can be cooled if a temperature of the magnet 24 exceeds a predetermined temperature. The predetermined temperature is preferably set at a temperature that would be below a temperature that would degrade the magnetic force capability of the magnet.

As shown in FIG. 1, the cooling circuit 40 is received within the second cavity 22 at a position adjacent to the magnet 24. A plug 42 seats a spot cooling lance 44 within the cavity 22. A sensor 46, such as a thermocouple for example, is used to sense the temperature of the magnet 24. The plug 42 can be configured to provide a support feature 48 to position the sensor 46 relative to the magnet 24. The sensor 46 can be configured to communicate with the electronic control unit 32 to monitor the temperature of the magnet 24 and to control the cooling circuit 40.

The cooling lance 44 includes an input path 50 that is used to direct a cooling fluid, such as water for example, into the cavity 22 to cool the magnet 24, and includes an output path 52 that draws heated fluid out of the cavity 22. It should be understood that while FIG. 1 shows a cooling circuit 40 for one of the two magnets 24, the cooling circuit 40 would also be used with additional magnets within the tooling. The cooling circuit 40 can be a dedicated cooling circuit for the magnets, or could be part of a tooling cooling circuit.

Using the magnets 24 to retain the inserts 12 within a single die 10 offers several advantages over prior tooling configurations. With prior configurations, in order to retain the bulkhead insert within the die, the insert had to be captured by extending a die piece through the cavity steel insert and main journal through hole of the bulkhead insert to lock it into place. This traditional approach is typical for cast-in cylinder liners, steering wheel armature hubs, and other examples where a mandrel or pin can retain the insert in the die draw. The disadvantage with this configuration is that the movement of the retention piece would be out of die draw, which would make die construction more complex and expensive, and would also increase maintenance requirements and costs in operation. Additionally, the position of the insert is critical for function of the engine, and the required clearances to allow proper function of the retaining die piece would not provide tight tolerance on location or position of the insert. Further, the required clearances would provide opportunity for flashing of molten aluminum to jam or lock the die components.

Using magnets to retain the insert in the correct position provides a configuration where there are no moving parts and no opportunity for flash related complications. Further, the magnets provide the ability to locate the insert tightly off of a single die piece (the same die piece where upper journal halves would be cast in a typical high pressure die cast engine block). Further, the use of a cooling circuit to cool the magnet prevents operating temperatures from exceeding the optimal temperature range of the magnet.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A casting assembly for an engine block comprising:

an insert;

at least one magnet configured to retain the insert in a predefined position within an engine block mold cavity; and an electrical circuit that cooperates with the at least one magnet to detect a presence of the insert in the engine block mold cavity.

2. The casting assembly of claim 1, wherein the insert comprises a bulkhead insert defining an engine crank bore.

3. The casting assembly of claim 1, wherein the magnet comprises an electromagnet or permanent magnet.

4. The casting assembly of claim 1, wherein the engine block is aluminum and the insert comprises a material other than aluminum.

5. The casting assembly of claim 4, wherein the material of the insert comprises a ferrous material.

6. The casting assembly of claim 1, including a cooling circuit to cool the at least one magnet if a temperature of the magnet exceeds a predetermined temperature.

7. The casting assembly of claim 6, wherein the engine block mold cavity is provided within a die, and wherein the die includes a bore configured to receive the magnet, and wherein the cooling circuit is at least partially received within the bore.

8. The casting assembly of claim 7, including at least one temperature sensor to determine the temperature of the magnet.

* * * * *